US009823609B2

(12) United States Patent
Tamada et al.

(10) Patent No.: US 9,823,609 B2
(45) Date of Patent: Nov. 21, 2017

(54) IMAGE FORMING APPARATUS

(71) Applicant: KONICA MINOLTA, INC., Chiyoda-ku, Tokyo (JP)

(72) Inventors: Takeshi Tamada, Toyohashi (JP); Mikiyuki Aoki, Toyohashi (JP); Seiichi Kirikubo, Toyohashi (JP); Akinori Kimata, Toyokawa (JP)

(73) Assignee: KONICA MINOLTA, INC., Tokyo (JP)

( * ) Notice: Subject to any disclaimer, the term of this patent is extended or adjusted under 35 U.S.C. 154(b) by 0 days.

(21) Appl. No.: 14/869,153

(22) Filed: Sep. 29, 2015

(65) Prior Publication Data

US 2016/0124356 A1 May 5, 2016

(30) Foreign Application Priority Data

Oct. 30, 2014 (JP) ..... 2014-221552

(51) Int. Cl.
*G03G 15/00* (2006.01)
*G03G 15/20* (2006.01)

(52) U.S. Cl.
CPC ..... *G03G 15/5004* (2013.01); *G03G 15/205* (2013.01); *G03G 15/2039* (2013.01); *G03G 15/80* (2013.01); *G03G 2215/0132* (2013.01)

(58) Field of Classification Search
CPC ..... G03G 15/205; G03G 15/5004
USPC ..... 399/44, 78, 88
See application file for complete search history.

(56) References Cited

U.S. PATENT DOCUMENTS 6,295,217 B1 * 9/2001 Yang ..... H02M 1/4258 363/21.1
2010/0230401 A1 * 9/2010 Miyauchi ..... H05B 6/062 219/665
2012/0107006 A1 * 5/2012 Yoda ..... G03G 15/205 399/70
2012/0177393 A1 * 7/2012 Ikebuchi ..... G03G 15/205 399/69

FOREIGN PATENT DOCUMENTS

JP 2002216986 A 8/2002
JP 2004021174 A 1/2004
JP 2009069371 A 4/2009
(Continued)

OTHER PUBLICATIONS

Japanese Office Action (and English translation thereof) dated Nov. 24, 2016, issued in counterpart Japanese Application No. 2014-221552.

*Primary Examiner* — Benjamin Schmitt
(74) *Attorney, Agent, or Firm* — Holtz, Holtz & Volek PC

(57) ABSTRACT

An image forming apparatus includes: a fixing part including a heater, and a first temperature detection part configured to detect the temperature of the heater; a chopper circuit including a reactor, a freewheeling element, and a switching element, the chopper circuit being configured to switch an input direct current on and off in a specified duty cycle by using the switching element and to supply the current to the heater; and a control part configured to control the duty cycle based on a detection result obtained by the first temperature detection part, as well as to control a switching frequency of the switching element based on an operation mode of the image forming apparatus.

8 Claims, 13 Drawing Sheets

(56) References Cited

FOREIGN PATENT DOCUMENTS

| | | | | | |
|---|---|---|---|---|---|
| JP | 2011081143 | A | * | 4/2011 | ..... G03G 15/20 |
| JP | 2012108288 | A | | 6/2012 | |
| JP | 2013038927 | A | | 2/2013 | |

* cited by examiner

IMAGE FORMING APPARATUS

The entire disclosure of Japanese Patent Application No. 2014-221552 filed on Oct. 30, 2014 including description, claims, drawings, and abstract are incorporated herein by reference in its entirety.

BACKGROUND OF THE INVENTION

Field of the Invention

The present invention relates to an image forming apparatus configured to control an input current to a heater placed in a fixing part by pulse width modulation (PWM).

Description of the Related Art

A conventional image forming apparatus of this type is described in JP 2009-69371 A mentioned below. In the image forming apparatus, a rectifier circuit converts an alternating current supplied from a commercial power supply to a direct current. An inverter circuit generates an alternating current from a direct current generated in the rectifier circuit, by switching a switching element on and off in a duty cycle specified by a control signal from a control part. The generated alternating current is supplied to the heater. In this manner, the input current to the heater is controlled.

Meanwhile, a known chopper circuit is also applicable to PWM control of the heater. The chopper circuit includes a switching element, a freewheeling element (a diode), and a reactor. The chopper circuit operates in a continuous current mode when driving the switching element in a high duty cycle (for example, at the time of printing). In the continuous current mode, problems may occur such as generation of recovery noise in the freewheeling element, and a temperature rise in the switching element due to switching loss.

SUMMARY OF THE INVENTION

In view of the foregoing, an object of the present invention is to provide an image forming apparatus including a chopper circuit, which is capable of preventing recovery noise in the freewheeling element, and a temperature rise in the switching element.

To achieve the abovementioned object, according to an aspect, an image forming apparatus reflecting one aspect of the present invention comprises: a fixing part having a heater, and a first temperature detection part configured to detect the temperature of the heater; a chopper circuit having a reactor, a freewheeling element, and a switching element, the chopper circuit being configured to switch an input direct current on and off in a specified duty cycle by using the switching element and to supply the current to the heater; and a control part configured to control the duty cycle based on a detection result obtained by the first temperature detection part, as well as to control a switching frequency of the switching element based on an operation mode of the image forming apparatus.

To achieve the abovementioned object, according to an aspect, an image forming apparatus reflecting one aspect of the present invention comprises: a fixing part having a heater, and a first temperature detection part configured to detect the temperature of the heater; a chopper circuit having a reactor, a freewheeling element, and a switching element, the chopper circuit being configured to switch an input direct current on and off in a specified duty cycle by using the switching element and to supply the current to the heater; and a control part configured to control the duty cycle based on a detection result obtained by the first temperature detection part. The control part is further configured to set a switching frequency of the switching element to a second frequency at which a current flowing in the heater is in a discontinuous current mode, when the duty cycle is higher than a specified first reference value, and to set the switching frequency to a first frequency which is higher than an audible range, when the duty cycle is lower than the first reference value.

To achieve the abovementioned object, according to an aspect, an image forming apparatus reflecting one aspect of the present invention comprises: a fixing part having a heater, and a first temperature detection part configured to detect the temperature of the heater; a chopper circuit having a reactor, a freewheeling element, and a switching element, the chopper circuit being configured to switch an input direct current on and off in a specified duty cycle by using the switching element and to supply the current to the heater; a current detection part configured to detect a current value of a current flowing in the heater; and a control part configured to control the duty cycle based on a detection result obtained by the first temperature detection part, as well as to control a switching frequency of the switching element based on a detection result obtained by the current detection part.

BRIEF DESCRIPTION OF THE DRAWINGS

The above and other objects, advantages and features of the present invention will become more fully understood from the detailed description given hereinbelow and the appended drawings which are given by way of illustration only, and thus are not intended as a definition of the limits of the present invention, and wherein.

DESCRIPTION OF THE PREFERRED EMBODIMENTS

Hereinafter, an embodiment of the present invention will be described with reference to the drawings. However, the scope of the invention is not limited to the illustrated examples.

Figure 1:
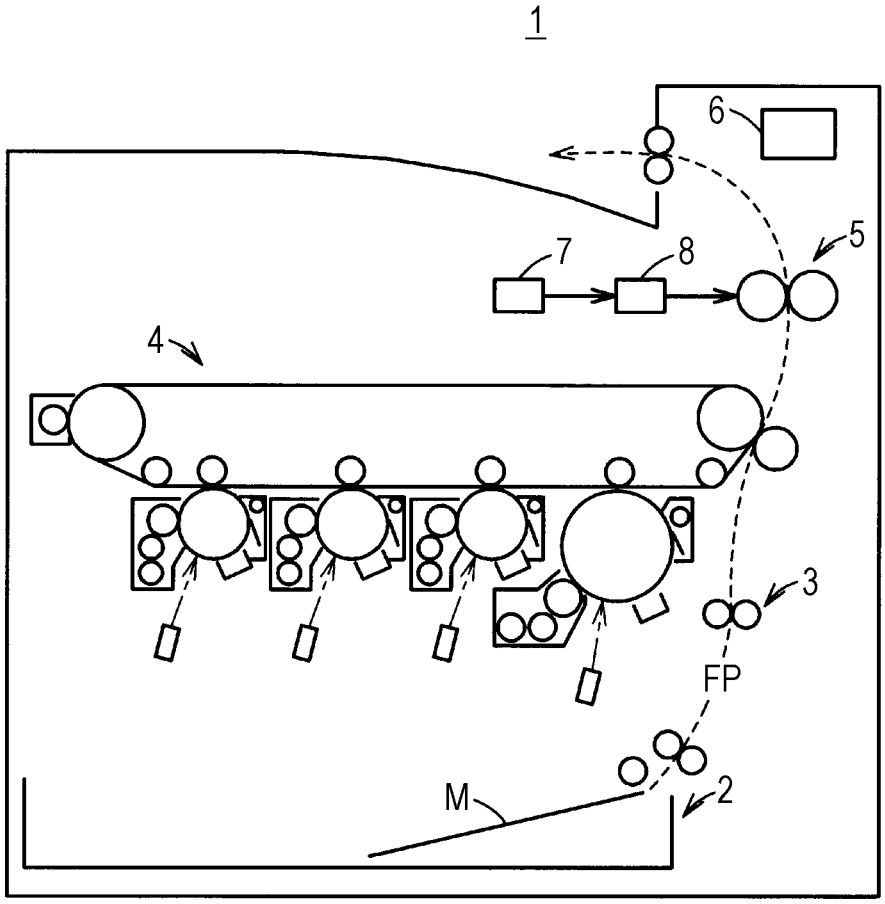
FIG. 1 is a diagram showing an entire configuration of the image forming apparatus.

Chapter 1: Entire Configuration of the Image Forming Apparatus; Printing Operation Examples of the image forming apparatus 1 shown in FIGS. 1 and 2 include a copying machine, a printing machine, and a fax machine, or a multifunction machine having functions of these machines. The image forming apparatus 1 prints an image on a sheet-shaped print medium M (e.g., a sheet of paper). For this purpose, the image forming apparatus 1 generally has a paper feeding part 2, a pair of paper stop rollers 3, an image forming part 4, a fixing part 5, an operation/input part 6, a control part 7, a power supply part 8, a current detection part 91, a voltage detection part 92, and a second temperature detection part 93. The following is a description of operations of the above components at a time when the image forming apparatus 1 is in printing operation. The current detection part 91 is used in the third embodiment. The voltage detection part 92 and the second temperature detection part 93 are used in the first and second modification examples of the second embodiment.

Unused sheets of the print medium M are stacked in the paper feeding part 2. The paper feeding part 2 sends the print medium M, sheet by sheet, to a feeding path FP represented by a broken line in FIG. 1. The pair of paper stop rollers 3 is placed on the feeding path FP, on the downstream side of the paper feeding part 2. The pair of paper stop rollers 3 stops temporarily the print medium M having been sent from the paper feeding part 2, and then sends the print medium M at a specified timing to a secondary transfer region.

The image forming part 4 generates a toner image on an intermediate transfer belt by, for example, an electrophotographic method and a tandem method which are well known. The toner image is supported by the intermediate transfer belt, and conveyed toward the secondary transfer region.

The print medium M is sent from the pair of paper stop rollers 3 to the secondary transfer region. Also, the toner image is conveyed from the image forming part 4 to the secondary transfer region. In the secondary transfer region, the toner image is transferred from the intermediate transfer belt to the print medium M.

In the fixing part 5, a heat roller 51 and a pressure roller 53 abut each other to form a nip. The heat roller 51 includes the heater 52 inside a cylindrical core bar thereof. The heater 52 is a halogen heater and the like, which is turned on by current supplied from the power supply part 8. The pressure roller 53 rotates under the control of the control part 7. The heat roller 51 rotates following the rotation of the pressure roller 53. When the print medium M is conveyed into the nip, the rollers 51 and 53 apply pressure to the print medium M. The heat roller 51 also applies heat to the print medium M. As a result, a toner is fixed to the print medium M. Afterward, the print medium M is conveyed to an exit tray.

The current detection part 91 detects, at regular intervals, a value of a current flowing in the heater 52 (i.e., a load current value), to output a detection result to the control part 7.

Further, the fixing part 5 includes a first temperature detection part 54 such as a thermistor. The first temperature detection part 54 detects the temperature of the heater 52, and outputs a detection result to the control part 7.

The operation/input part 6 includes a numeric keypad and a touch screen. A user inputs various kinds of information by operating the operation/input part 6.

In the control part 7, a central processing unit (CPU) runs a program stored in a read-only memory (ROM), using a random access memory (RAM) as a work area. The control part 7 performs various controls. Among them, control of input current to the heater 52 is particularly important in the present embodiment. Specifically, the control part 7 controls by PWM a duty cycle of a switching element 831 which is described later, so that a detection result obtained by the first temperature detection part 54 can equal a desired temperature. The duty cycle is determined by proportional-integral-derivative/differential (PID) control and proportional-integral (PI) control which are well known. Further, the control part 7 controls the switching frequency (i.e., the switching cycle) of the switching element 831, based on an operation mode of the image forming apparatus 1 (see the first embodiment), a duty cycle of the switching element 831 (see the second embodiment), or a value of a current flowing in the heater 52 (see the third and fourth embodiments).

Chapter 2: Configuration of the Power Supply Part

Figure 2:
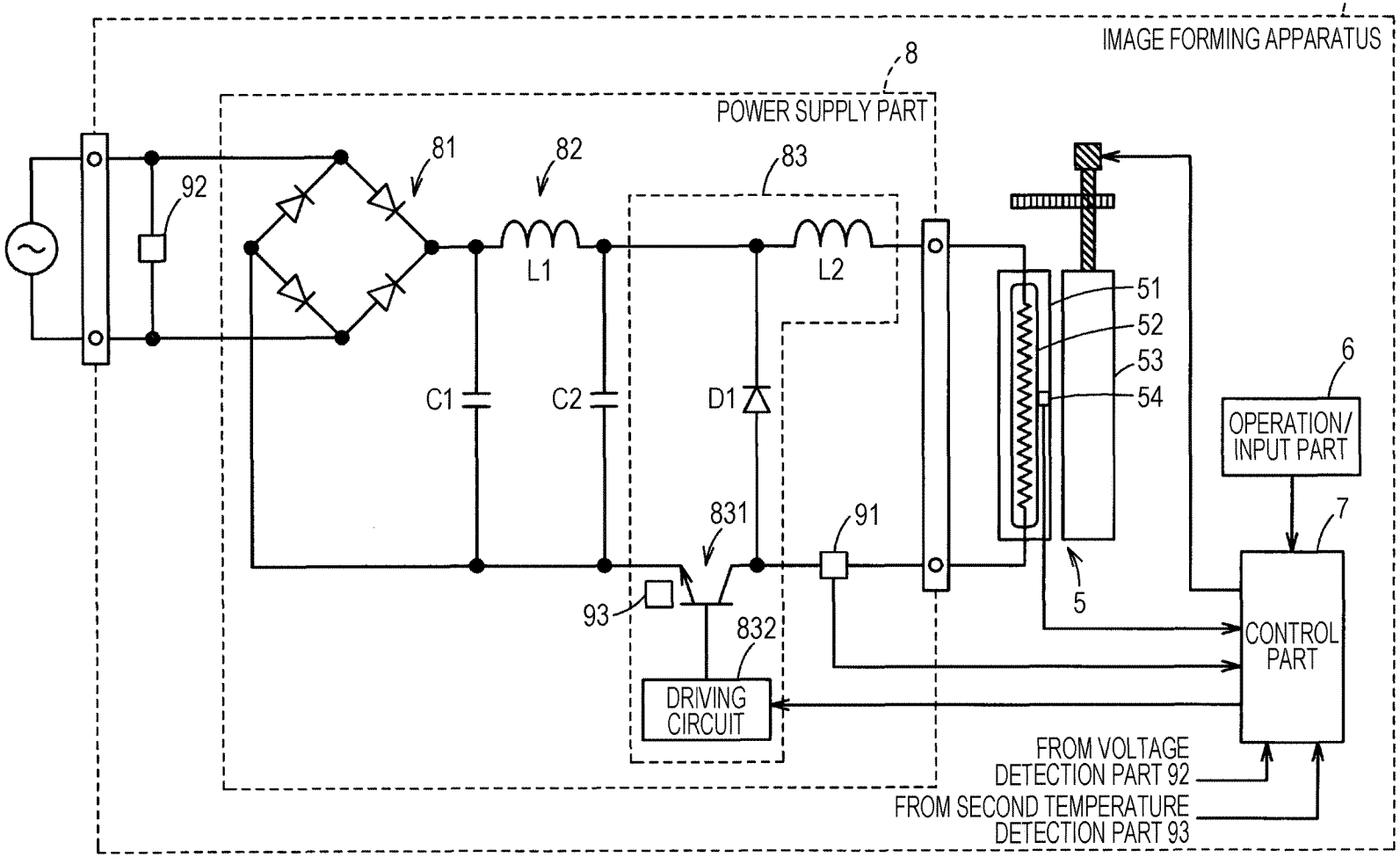
FIG. 2 is a diagram showing a main portion of the image forming apparatus.

As shown in FIG. 2, the power supply part 8 includes a rectifier circuit 81, a noise filter 82, and a chopper circuit 83.

The rectifier circuit 81 is connected to a commercial power supply.

The noise filter 82 such as a n-type filter is cascade-connected to the output side of the rectifier circuit 81. Specifically, the noise filter 82 includes a coil L1 and a capacitor C1, C2. The coil L1 is connected in series to the heater 52. The capacitor C1, C2 is connected in parallel to the heater 52.

The chopper circuit 83 such as a step-down chopper circuit is cascade-connected to the output side of the filter 82. In this case, the chopper circuit 83 includes a coil (a reactor) L2, a freewheeling element D1, the switching element 831, and a driving circuit 832.

The coil L2 is connected in series to the coil L1 and the heater 52, being interposed between them.

The freewheeling element D1 such as a diode is connected in parallel to the heater 52, being placed on the filter 82 side of the coil L2. More specifically, the freewheeling element D1 is located in such a manner that the cathode thereof is interposed between and electrically connected to the coils L1 and L2, and the anode thereof is interposed between and electrically connected to the heater 52 and a collector of the switching element 831.

Examples of the switching element 831 includes an insulated gate bipolar transistor (IGBT), and a metal-oxide-semiconductor field-effect transistor (MOS-FET). The switching element 831 is connected in series to the heater 52, being placed on the filter 82 side of the freewheeling element D1. More specifically, the switching element 831 is located in such a manner that the collector thereof is electrically connected to the heater 52, and an emitter thereof is electrically connected to the output side of the rectifier circuit 81. The driving circuit 832 is connected to a gate of the switching element 831. The driving circuit 832 sets, under the control of the control part 7, a duty cycle and a driving frequency of the switching element 831. The heater 52 is connected to the above-mentioned output terminals of the chopper circuit 83.

Chapter 3: General Method of Control of Input Current to the Heater

In this chapter, a general method of control of input current to the heater 52 is described, with reference to FIGS. 1 to 6.

First, the rectifier circuit 81 full-wave rectifies an alternating current supplied from the commercial power supply, to generate a direct current. The filter 82 removes noise from a current having been output from the rectifier circuit 81. The capacitor C1, C2 of the filter 82 prevents a high-frequency component of a pulsed current passing through the switching element 831 from leaking to the commercial power supply side.

When power is supplied to the heater 52, the control part 7 inputs a control signal to the driving circuit 832. The control signal indicates at least a time section during which the heater 52 is on (i.e., a duty cycle). The driving circuit 832 generates a driving signal to turn on and off the switching element 831 in the duty cycle indicated by the control signal having been input thereto. The driving circuit then supplies the driving signal to the gate of the switching element 831. At this time, the switching element 831 is driven at a frequency (for example, 20 kHz) which is much higher than a frequency of the commercial power supply.

Figure 3:
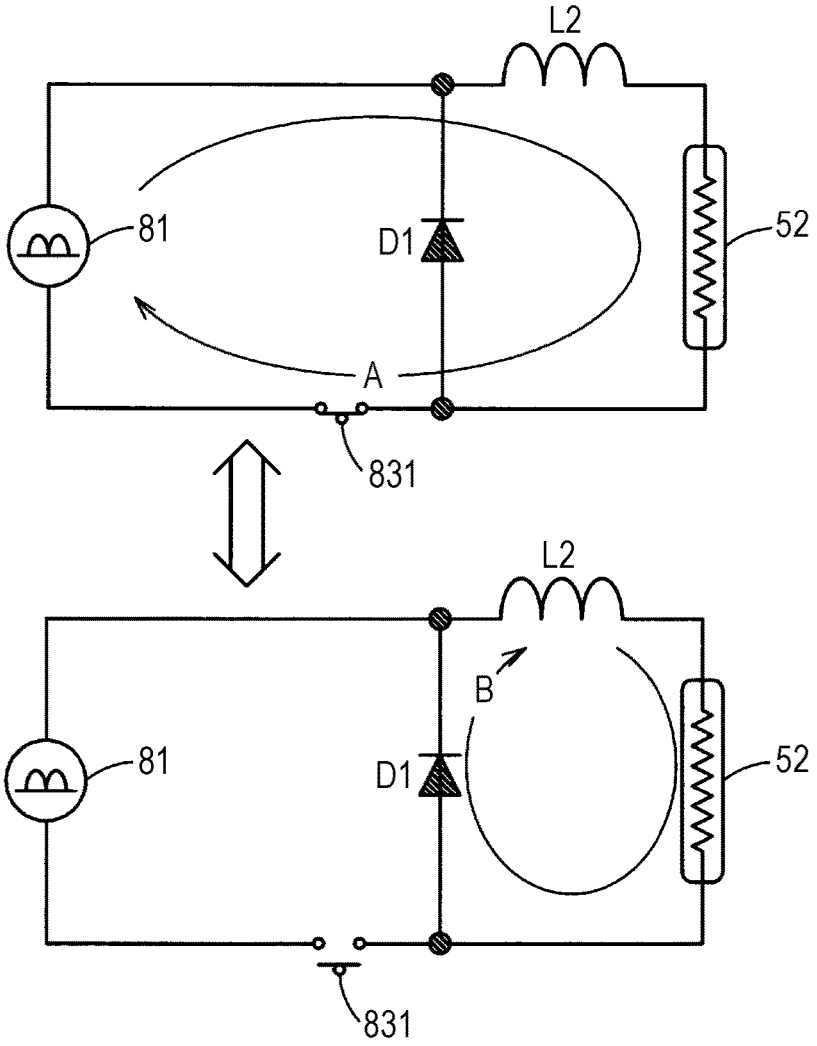
FIG. 3 is a diagram showing, in the upper and lower figures, a current flowing in the heater during a time when the switching element is on and off, respectively.

When the switching element 831 is on, a direct current generated in the rectifier circuit 81 flows through the coil L2 and the heater 52 via the switching element 831, as indicated by an arrow A in the upper figure of FIG. 3. At the same time, the coil L2 stores part of the direct current passing therethrough in the form of magnetic energy.

When the switching element 831 is off, magnetic energy having been stored in the coil L2 while the switching element 831 is on is released in the form of a current. Then the current starts to flow to the heater 52, as indicated by an arrow B in the lower figure of FIG. 3. The current returns to the coil L2 via the freewheeling element D1 as a regenerative diode.

Figure 4:
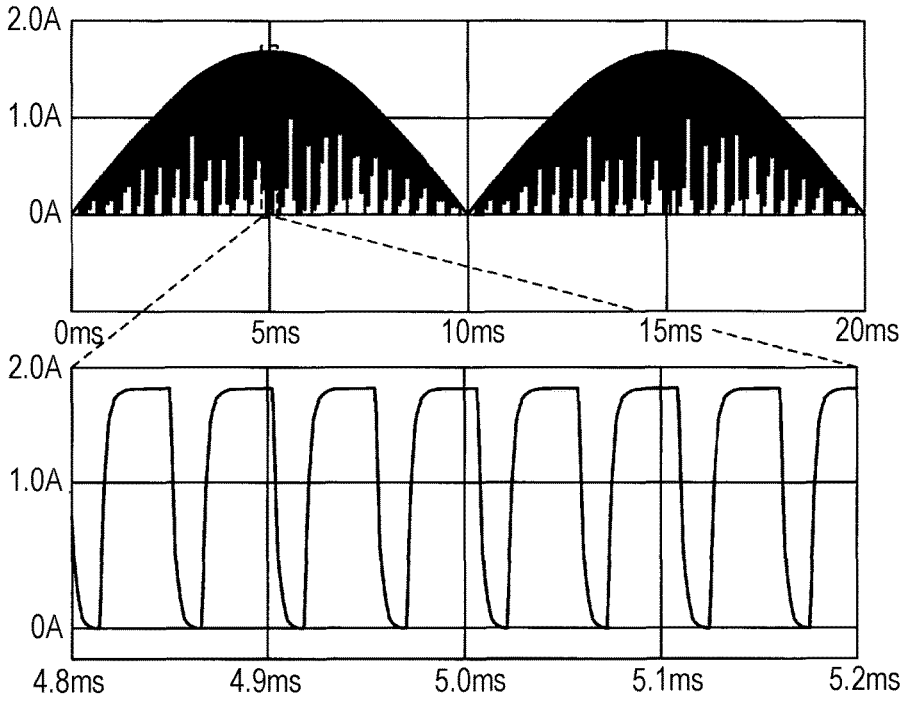
FIG. 4 is a diagram showing an example of a waveform of a current flowing in the heater.

By the above-described operation of the power supply part 8, a waveform of a current which is input to the heater 52 resembles a sine wave in shape, as shown in FIG. 4. As a result, a power factor of the power supply part 8 increases, and, at the same time, a harmonic current is reduced from the current input to the heater 52.

In addition, by increasing or decreasing the duty cycle by PWM control, the current input to the heater 52 is regulated, so that power consumption of the heater 52 is controlled with high accuracy. This prevents a temperature ripple in the fixing part 5. As a result, color development at the time of color printing is stabilized.

Figure 5:
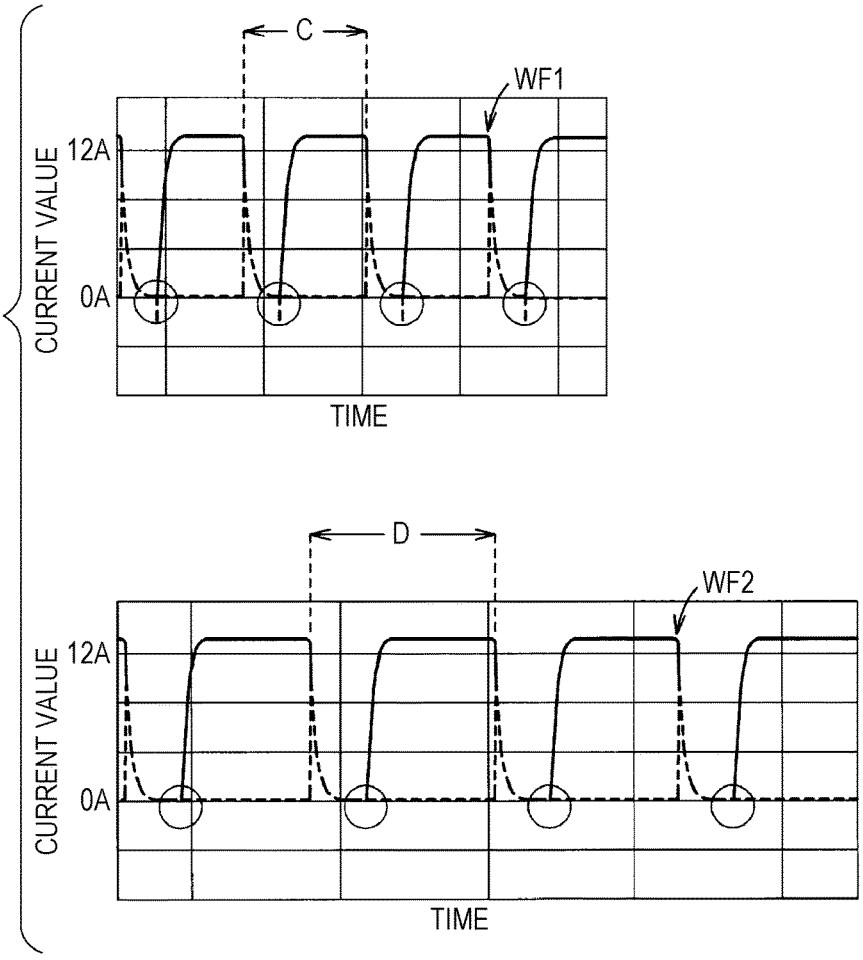
FIG. 5 is a diagram showing, in the upper and lower figures, a waveform of a current flowing in the heater at a time when a switching frequency is high and outside an audible range, with a high duty cycle, and when the switching frequency is low and within the audible range, with a high duty cycle, respectively.

As shown in the upper figure of FIG. 5, a current flowing in the coil L2 and the heater 52 is a combined current obtained by combining, on the time axis, an input current from the rectifier circuit 81 (represented by a solid line), and a return-flow current (represented by a dotted line) having passed through the freewheeling element D1 when the switching element 831 is off. The upper figure of FIG. 5 shows a waveform WF1 of a current flowing in the heater 52 in a duty cycle of 70%. In the case of a high switching frequency (i.e., a short switching cycle C), the current flowing in the heater 52 is in a continuous current mode. The continuous current mode means a mode in which a current flowing in the heater 52 does not practically decrease to zero (0). In the continuous current mode, as indicated by the current waveform WF1, before a current of a cycle decreases to zero ampere (0 A), a current of the next cycle is supplied from the rectifier circuit 81. In other words, the switching element 831 is switched to the on-state while a return-flow current is flowing in the heater 52. As shown in a circle in the upper figure of FIG. 5, therefore, a current value does not decrease to zero (0) at a cycle changeover point, with a recovery current flowing in the freewheeling element D1. In this condition, recovery noise is likely to increase. In addition, switching loss is caused by turning on the switching element 831 while a current is flowing in the freewheeling element D1, which results in increase in temperature of the switching element 831.

On the other hand, as indicated by a current waveform WF2 in the lower figure of FIG. 5, when a switching frequency is lowered while maintaining the duty cycle at approximately 70% (i.e., a long switching cycle D), ample time is allowed for a current to decrease after the switching element 831 is turned off. As a result, as shown in a circle in the lower figure of FIG. 5, a current value decreases to zero (0) at a cycle changeover point. In other words, a current flowing in the coil L2 changes to the discontinuous current mode. In this manner, a recovery current flowing in the freewheeling element D1 (i.e., recovery noise) is prevented. However, there is another problem. When the switching frequency is within an audible range which is equal to or lower than 10 kHz, the coil L2 vibrates. This causes the image forming apparatus 1 to generate sound noise.

Normally, the image forming apparatus 1 operates in a power saving mode in standby time and the like. During the time of the power saving mode, a desired temperature in PWM control is set lower than during the time of printing operation (i.e., when a printing job is running). Generally, therefore, in PWM control in the power saving mode, the duty cycle is set relatively low at approximately 30% for example, while the cycle C is maintained, as indicated by a current waveform WF3 in FIG. 6. In this case, a current flowing in the heater 52 is in the discontinuous current mode, with a period in which the current value is zero (0). In the example shown in FIG. 6, a return-flow current (represented by a dotted line) decreases to zero (0) at the timing of turning on the switching element 831.

Chapter 4: Background of Control of Input Current to the Heater According to the Present Embodiment A large amount of current supply to the heater 52 (or a high duty cycle of a current supplied to the heater 52) means that printing operation is running in the image forming apparatus 1. The image forming apparatus 1, when printing, basically makes relatively loud sound noise caused by paper feeding, driving, and the like. Even if, therefore, sound noise due to vibration of the coil L2 is generated during printing operation, the sound noise is not clearly recognized. On the other hand, a small amount of current supply to the heater 52 (or a low duty cycle of a current supplied to the heater 52) means that the image forming apparatus 1 is in a standby state, making relatively low sound noise. If the coil L2 creates sound noise during the standby state, therefore, the sound noise is clearly recognized. The switching frequency of the switching element 831 is controlled in the present embodiment, taking the above background into consideration. Control of input current to the heater 52 according to the first embodiment is described below in detail, with reference to FIGS. 7 and 8 in addition to FIGS. 1 to 6.

Chapter 5: Control of Input Current to the Heater According to the First Embodiment The following description particularly refers to FIG. 7. Normally, turning on and off of the heater 52 is not controlled during the time when the operation mode of the image forming apparatus 1 is in an initial state between activating the main power supply and starting warm-up. During the initial state, the control part 7 outputs a first control signal to the driving circuit 832. The first control signal specifies the duty cycle of 0%, and the switching frequency of approximately 20 kHz which is outside the audible range. Since the duty cycle is 0%, an effect of the switching frequency is not observed.

Figure 8:
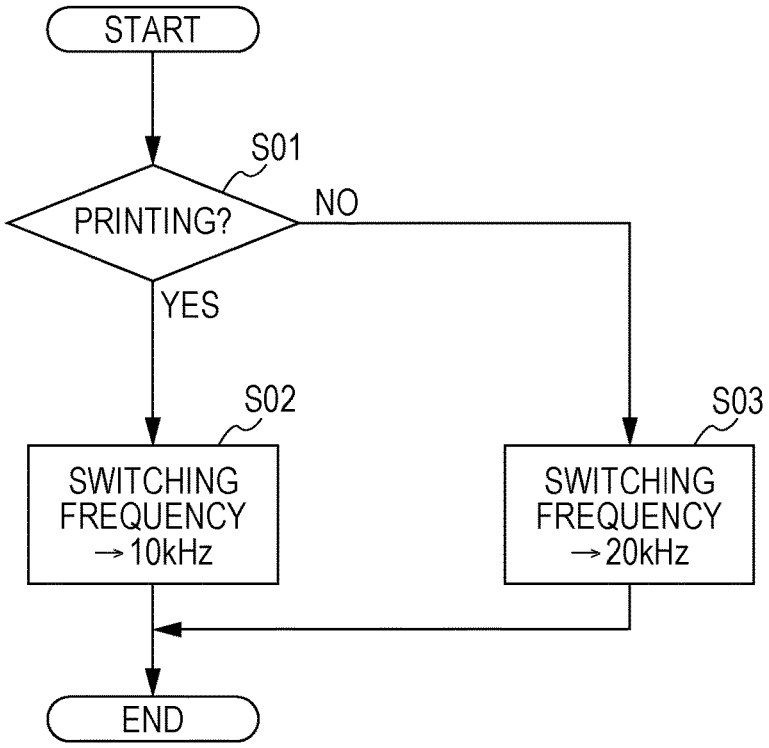
FIG. 8 is a flow diagram illustrating a process performed by the control part in input current control according to the first embodiment.

During the time when the operation mode is in a warm-up state following to the initial state, the heater 52 is on continuously, independently of the process illustrated in FIG. 8. During the warm-up state, the control part 7 outputs a second control signal to the driving circuit 832. The second control signal specifies the duty cycle of 100%, and the switching frequency of approximately 20 kHz which is outside the audible range. Since the duty cycle is 100%, an effect of the switching frequency is not observed.

Figure 6:
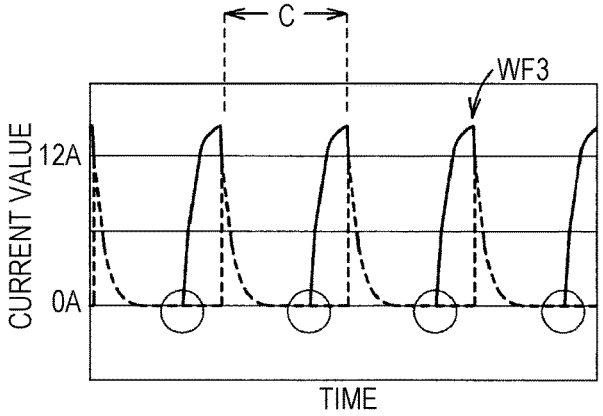
FIG. 6 is a diagram showing a waveform of a current flowing in the heater at a time when a switching frequency is high and outside an audible range, with a low duty cycle.
Figure 7:
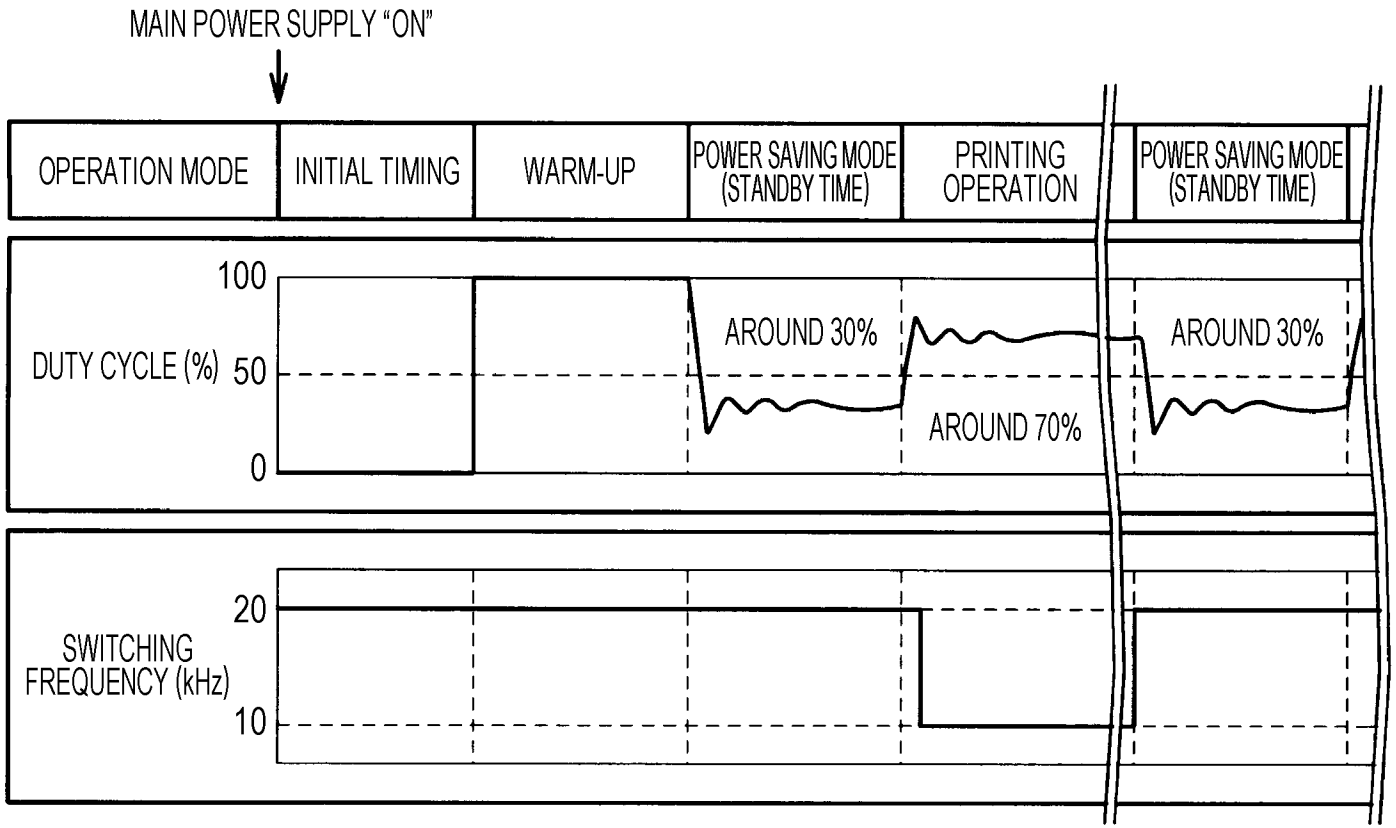
FIG. 7 is a timing chart for input current control according to a first embodiment.

After the warm-up is finished, the operation mode changes to a power saving mode (such as a standby state) which is an example of a first operation mode. During the power saving mode, the control part 7 outputs a third control signal to the driving circuit 832. The third control signal specifies a relatively low value of the duty cycle, such as around 30%. The switching frequency is set to the first frequency which is outside the audible range, such as approximately 20 kHz. The driving circuit 832 drives the switching element 831 as specified by the third control signal. In this case, since an amount of power supplied to the heater 52 is small, a current supplied to the heater 52 is maintained in the discontinuous current mode as shown in FIG. 6, even though the switching frequency is high at approximately 20 kHz. In this manner, problems such as recovery noise in the freewheeling element D1 and a temperature rise in the switching element 831 are resolved. Moreover, the coil L2 is prevented from generating sound noise.

When a printing job is transmitted, in the power saving mode, to the control part 7 from a personal computer (PC) or the like connected to the image forming apparatus 1, the operation mode of the image forming apparatus 1 changes to printing operation which is an example of a second mode. Then the control part 7 controls the printing operation described in Chapter 1. During printing operation, an amount of power consumption of the image forming apparatus 1 is larger than in the power saving mode, due to paper feeding and motor driving. The control part 7 outputs a fourth control signal to the driving circuit 832. The fourth control signal specifies a relatively high value of the duty cycle, such as around 70%. The switching frequency is set to the second frequency of 10 kHz, for example, which is within an audible range and also is lower than the first frequency. The driving circuit 832 drives the switching element 831 as specified by the fourth control signal. As the switching frequency is low, a current flowing in the heater 52 is in a discontinuous current mode as shown in the lower figure of FIG. 5, avoiding the continuous current mode shown in the upper figure of FIG. 5. In this manner, problems such as recovery noise in the freewheeling element D1 is resolved. In this case, the coil L2 is not prevented from generating sound noise. However, the image forming apparatus 1 originally generates a relatively large sound noise due to paper feeding, driving, and the like. Since this sound noise drowns out the sound noise from the coil L2, it is not a problem even if the coil L2 is not prevented from generating sound noise.

The following description particularly refers to FIG. 8. As described previously, FIG. 8 illustrates switching frequency setting operation in the input current control according to the first embodiment. The control part 7 determines whether or not the image forming apparatus 1 is in printing operation (i.e., in a second operation mode) (step S01). If Yes, the control part 7 selects the second frequency which is within the audible range (for example, approximately 10 kHz) as the switching frequency (step S02). If No, the control part 7 determines that the image forming apparatus 1 is in the first operation mode, and selects the first frequency which is outside the audible range (for example, approximately 20 kHz) as the switching frequency (step S03).

While performing the process of FIG. 8, after the main power supply of the image forming apparatus 1 has been activated, the control part 7 also determines the duty cycle by PWM control as previously described, so that the detection result obtained by the first temperature detection part 54 can equal a desired temperature.

After determining the duty cycle and the switching frequency, the control part 7 generates various control signals and outputs the signals to the driving circuit 832. The driving circuit 832 turns on and off the switching element 831 in the duty cycle indicated by the input control signal. At the same time, the driving circuit 832 generates a driving signal to drive the switching element 831 at the switching frequency indicated by the control signal, and supplies the signal to the gate of the switching element 831.

Chapter 6: Effect of the Control of Input Current to the Heater According to the First Embodiment According to the present embodiment, during the PWM control based on the detection result obtained by the first temperature detection part 54, the control part 7 sets the switching frequency at a low frequency which is within the audible range, at the time of printing operation. As a result, a current flowing in the heater 52 is in the discontinuous current mode (see the lower figure of FIG. 5). In this manner, recovery noise in the freewheeling element D1 and/or a temperature rise in the switching element 831 are prevented. In addition, the image forming apparatus 1 originally generates relatively loud sound noise during printing operation, which prevents people around the image forming apparatus 1 from feeling annoyed by sound noise produced by the coil L2.

Chapter 7: Control of Input Current to the Heater According to the Second Embodiment This chapter refers to FIGS. 9 and 10 in addition to FIGS. 1 to 6.

Figure 9:
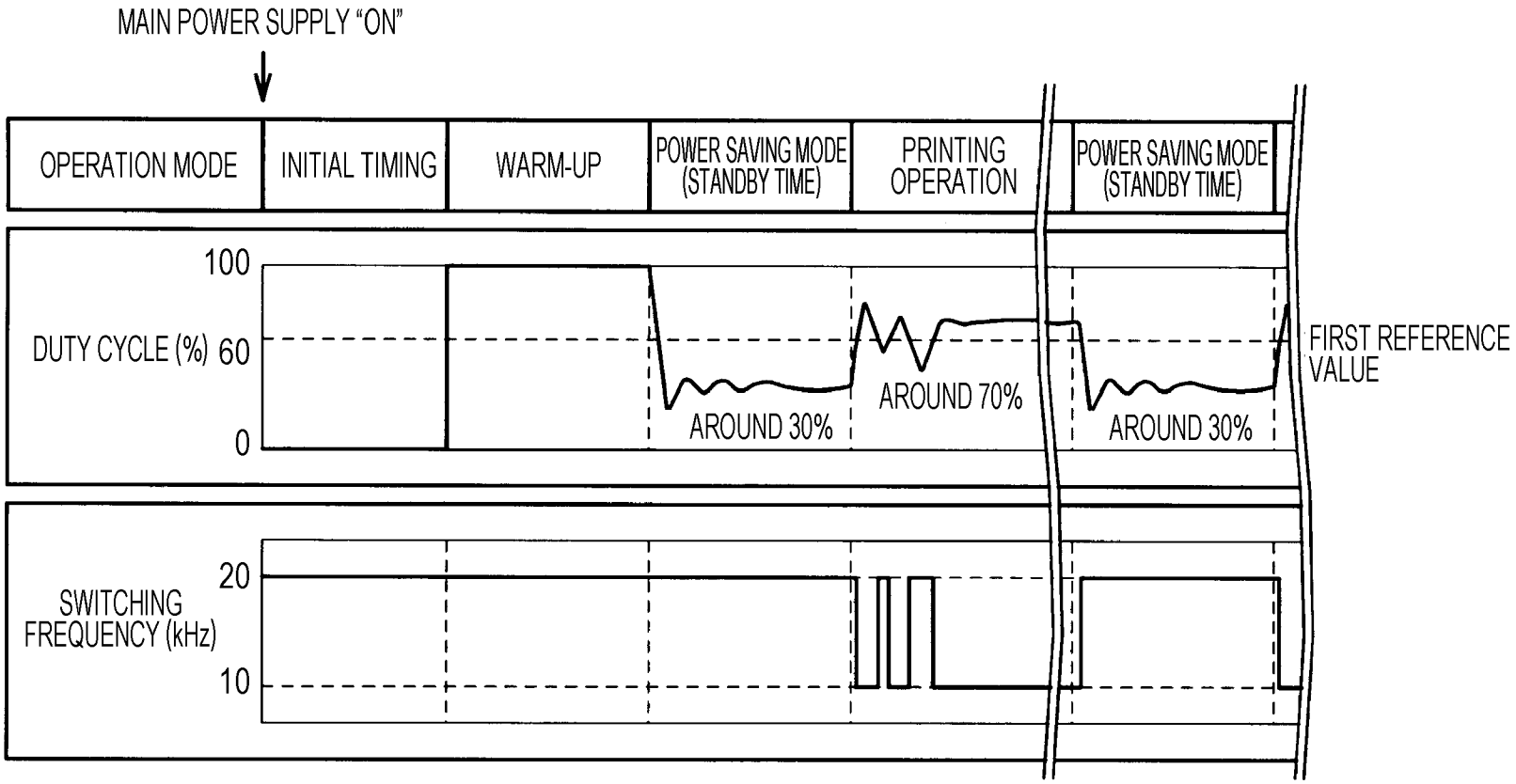
FIG. 9 is a timing chart for input current control according to a second embodiment.

First, the following description particularly refers to FIG. 9. As shown in FIG. 9, the control part 7 outputs the second control signal having the same characteristics as described earlier to the driving circuit 832, so that the heater 52 can be on continuously during warm-up operation.

In an operation mode other than the warm-up mode, when the duty cycle determined by PID control or the like is lower than a predetermined first reference value (e.g., 60%), the control part 7 outputs a fifth control signal to the driving circuit 832 so as to set the switching frequency at the first frequency of approximately 20 kHz, for example, which is outside the audible range. The first reference value is determined appropriately in accordance with specifications and characteristics of the freewheeling element D1 and the switching element 831. The fifth control signal includes information about the determined duty cycle as the other control signals do. In this manner, the heater 52 is supplied with a pulsed current in the duty cycle of lower than 60% and at a frequency of approximately 20 kHz, for example.

When the determined duty cycle is equal to or higher than the first reference value, the control part 7 outputs a sixth control signal to the driving circuit 832 so as to set the switching frequency at the second frequency of approximately 10 kHz, for example, which is within the audible range. The sixth control signal also includes information about the determined duty cycle as the other control signals do. In this manner, the heater 52 is supplied with a pulsed current in the duty cycle of higher than 60% and at a frequency of approximately 10 kHz, for example.

Figure 10:
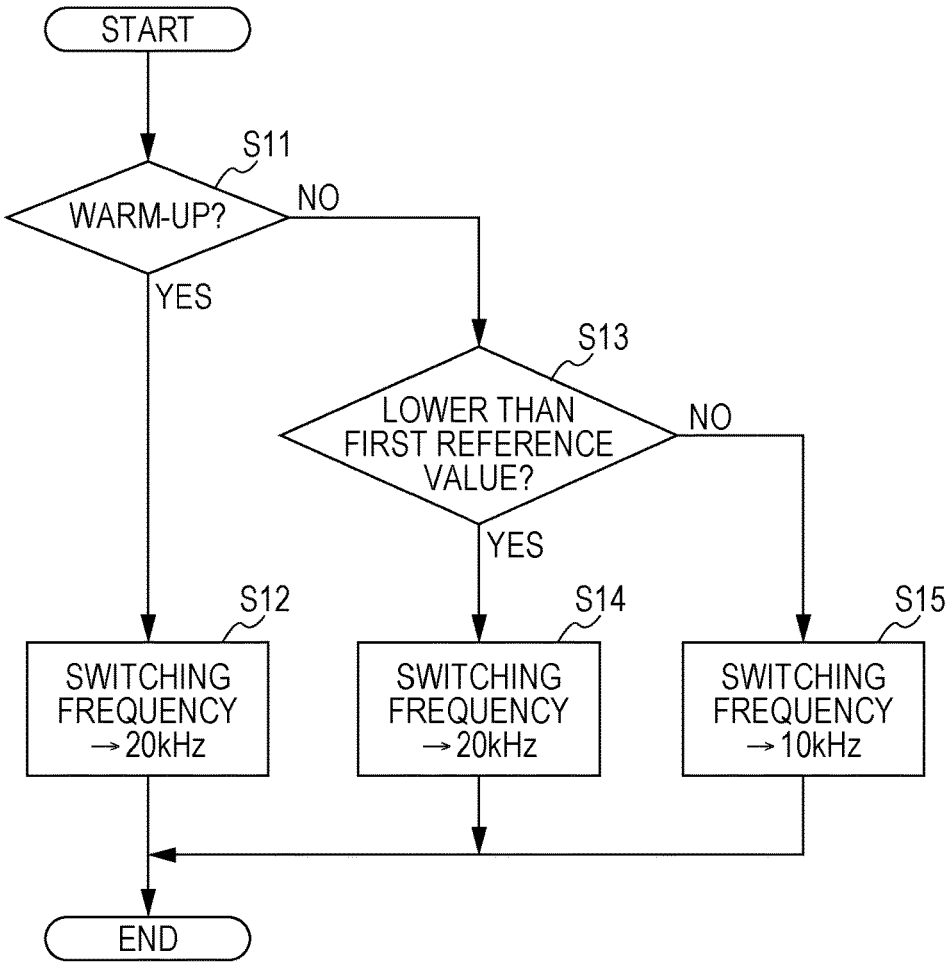
FIG. 10 is a flow diagram illustrating a process performed by the control part in input current control according to the second embodiment.

Next, the following description particularly refers to FIG. 10. FIG. 10 illustrates a switching frequency setting process performed by the control part 7 each time the duty cycle is determined by PID control or the like. As shown in FIG. 10, the control part 7 determines whether or not the present operation mode is the warm-up mode (step S11). When the control part 7 determines the present operation mode is the warm-up mode (Yes in step S11), the control part 7 selects the first frequency (e.g., approximately 20 kHz) as the switching frequency (step S12).

When the control part 7 determines the present operation mode is not the warm-up mode (No in step S11), the control part 7 determines whether or not the duty cycle determined by PID control or the like is lower than the first reference value mentioned above (step S13). If Yes, the control part 7 selects the first frequency (e.g., approximately 20 kHz) as the switching frequency (step S14). If No, the control part 7 selects the second frequency (e.g., approximately 10 kHz) as the switching frequency (step S15). After determining the switching frequency by the above process, the control part 7 generates and outputs the control signal described above.

Chapter 8: Effect of the Control of Input Current to the Heater According to the Second Embodiment The input current control of the present embodiment is more complicated than that of the first embodiment. Specifically, in printing operation, the switching frequency is not always set at the second frequency which is within the audible range, but is set at the first frequency which is outside the audible range when the duty cycle is low. This makes it possible to reduce the sound noise level at the time of printing operation lower than that in the first embodiment, as well as to avoid recovery noise and switching loss.

Chapter 9: First Modification Example

In PID control or the like, when the level of an input voltage to the power supply part 8 changes, a duty cycle at which a continuous current mode is switched to a discontinuous current mode or vice versa (hereinafter called a switching duty cycle) changes. Specifically, as the input voltage level increases, the switching duty cycle decreases. When the image forming apparatus 1 has, as shown in FIG. 2, a voltage detection part 92 which is able to detect the level of the input voltage to the power supply part 8, the voltage detection part may determine, for example, that the actual level of the input voltage is 108 V with respect to the rated AC voltage of 100 V. In such a case, based on the foregoing description, it is desirable that the control part 7 change the first reference value used in step S13 from 60% to 58%, for example.

Chapter 10: Second Modification Example

The image forming apparatus 1 can be configured to satisfying both the first and second embodiments. In such a case, a user operates the operation/input part 6 which is an example of a setting part so as to set, in the control part 7, information indicating whether the switching frequency is controlled based on the operation mode, or on the duty cycle determined by PID control or the like. The control part 7 determines, based on the information having been set, which of the first and second embodiments is implemented.

Chapter 11: Control of Input Current to the Heater According to the Third Embodiment This chapter refers to FIGS. 11 and 12 in addition to FIGS. 1 to 6.

Figure 11:
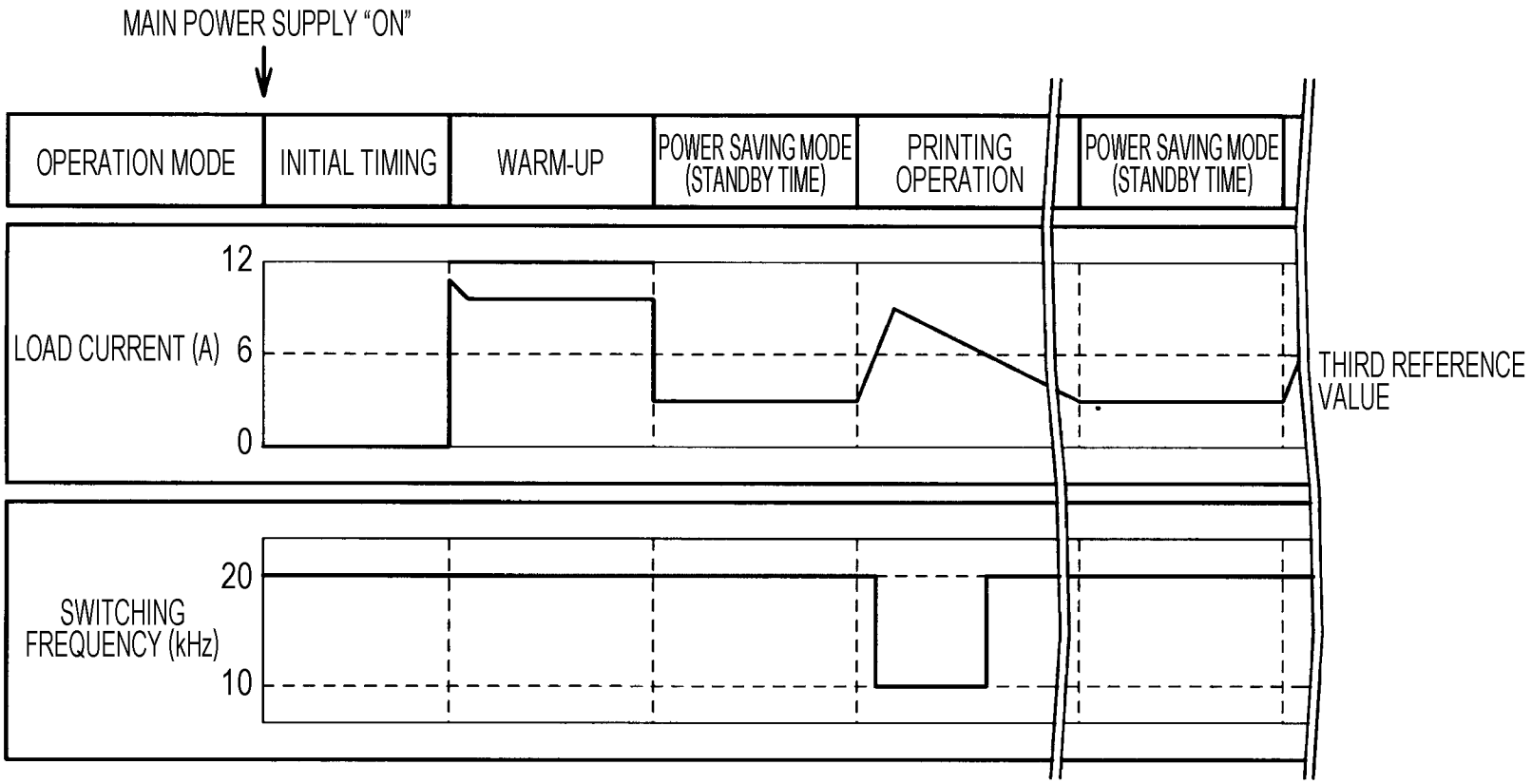
FIG. 11 is a timing chart for input current control according to a third embodiment.

First, the following description particularly refers to FIG. 11. In the case of FIG. 11, the control part 7 outputs the second control signal having the same characteristics as described earlier to the driving circuit 832, independently of the detection result obtained by the current detection part 91, thereby the heater 52 is supplied with a current in the duty cycle of 100% so as to be on continuously during warm-up operation.

In an operation mode other than the warm-up mode, the control part 7 calculates, based on the detection result obtained by the current detection part 91, an effective value or a mean value of a pulsed current supplied to the heater 52 with respect to a predetermined time section (e.g., one (1) cycle).

When the value obtained as a calculation result is lower than a specified third reference value (e.g., 6 A), the control part 7 determines it is unlikely that problems such as recovery noise have occurred. The third reference value is determined appropriately in accordance with specifications and characteristics of the freewheeling element D1 and the switching element 831. In this case, the control part 7 outputs the fifth control signal mentioned before to the driving circuit 832 so as to set the switching frequency at the first frequency of approximately 20 kHz, for example, which is outside the audible range.

On the other hand, when the calculation result is equal to or higher than the third reference value (e.g., 6 A), the control part 7 determines that problems such as recovery noise are highly likely to occur. In this case, the control part 7 outputs the sixth control signal mentioned before to the driving circuit 832 so as to set the switching frequency at the second frequency of approximately 10 kHz, for example, which is within the audible range.

Figure 12:
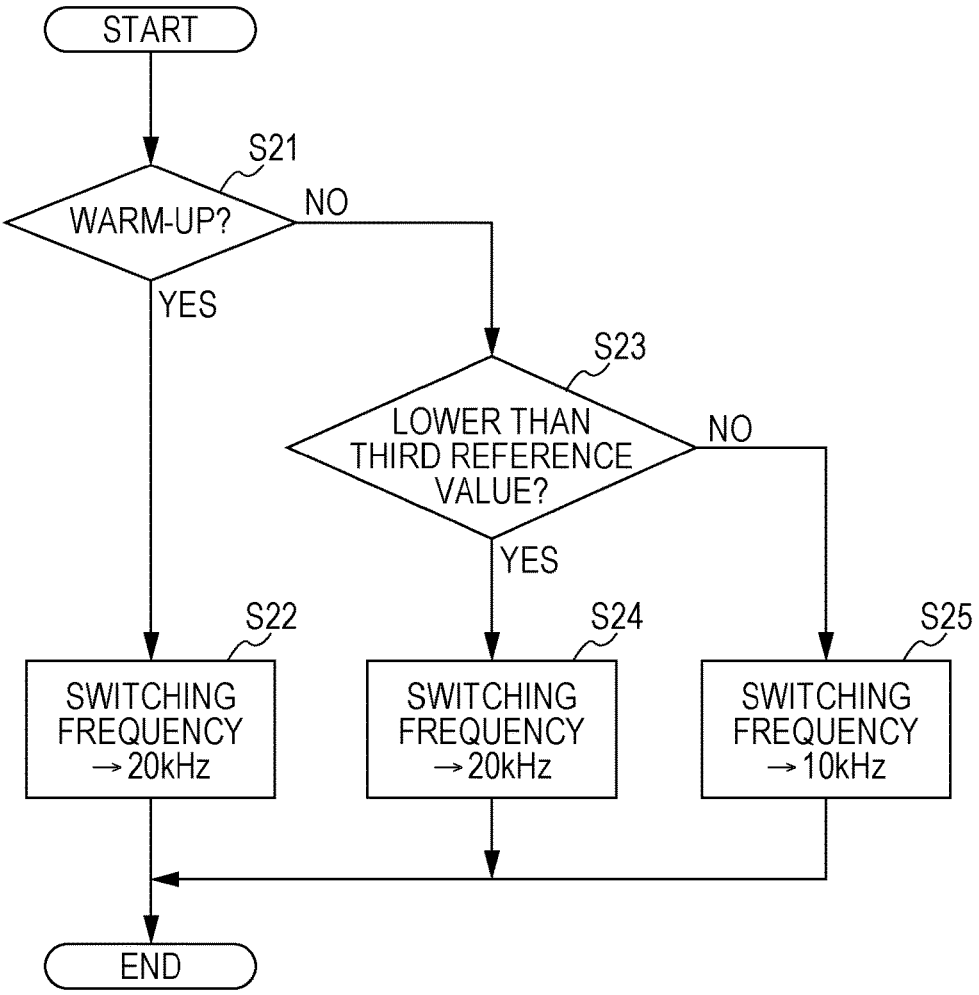
FIG. 12 is a flow diagram illustrating a process performed by the control part in input current control according to the third embodiment.

Next, the following description particularly refers to FIG. 12. FIG. 12 illustrates a switching frequency setting process performed by the control part 7 each time the duty cycle is determined by PID control or the like. As shown in FIG. 12, the control part 7 determines whether or not the present operation mode is the warm-up mode (step S21). When the control part 7 determines the present operation mode is the warm-up mode (Yes in step S21), the control part 7 selects the first frequency as the switching frequency (step S22).

When the control part 7 determines the present operation mode is not the warm-up mode (No in step S21), the control part 7 calculates the aforementioned values including the mean value, based on the detection result obtained by the current detection part 91, and determines whether or not the calculation result is lower than the third reference value mentioned above (step S23). If Yes, the control part 7 selects the first frequency as the switching frequency (step S24). If No, the control part 7 selects the second frequency as the switching frequency (step S25).

Chapter 12: Effect of the Control of Input Current to the Heater According to the Third Embodiment By the input current control of the present embodiment, the sound noise level at the time of printing operation is reduced lower than that in the first embodiment. In addition, problems such as recovery noise are avoided.

Chapter 13: Third Modification Example

When the image forming apparatus 1 has, as shown in FIG. 2, a voltage detection part 92 which is able to detect the level of the input voltage to the power supply part 8, the voltage detection part may determine, for example, that the actual level of the input voltage is 108 V with respect to the rated AC voltage of 100 V. In such a case, it is desirable that the control part 7 automatically change the third reference value used in step S23, S24 from 6 A to 6.5 A, for example.

Chapter 14: Control of Input Current to the Heater According to the Fourth Embodiment This chapter refers to FIGS. 13 and 14 in addition to FIGS. 1 to 6.

Figure 13:
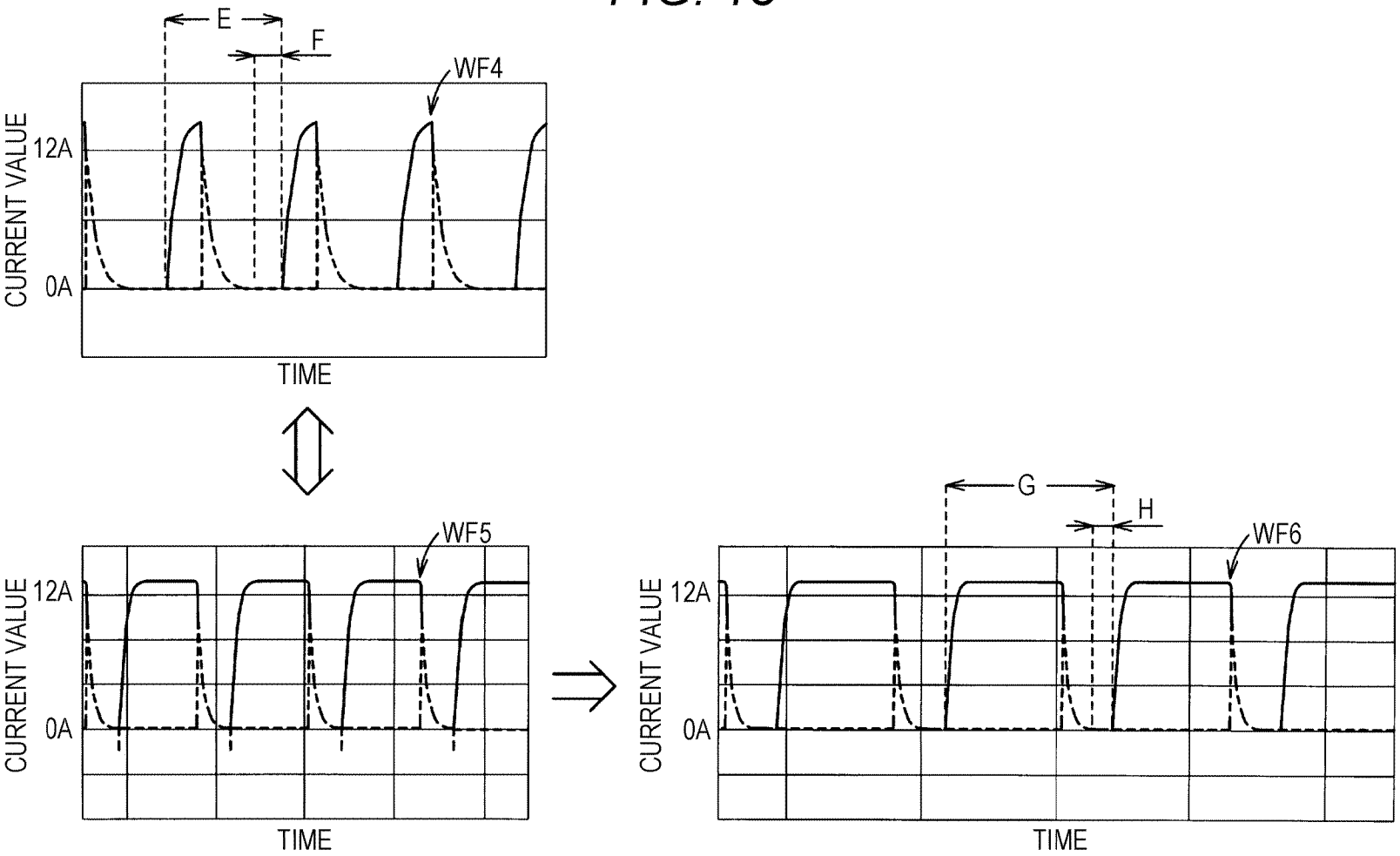
FIG. 13 is a diagram showing a waveform of a pulsed current supplied to the heater in input current control according to a fourth embodiment.

The upper figure of FIG. 13 shows a first example of a waveform WF4 of a pulsed current supplied from the power supply part 8 to the heater 52. The first example pulsed current is output from the power supply part 8 in a low power mode or the like. The frequency of the first example pulsed current is the first frequency (i.e., the frequency of 20 kHz or 50 μsec-cycle (see an arrow E)). The duty cycle of the current is set at a relatively low value such as around 30%. The pulsed current is in the discontinuous current mode. In the pulsed current, therefore, recovery noise is not generated. A time section of approximately 6 μsec during which the current value is 0 A is maintained in the current (see an arrow F).

On the left side of the lower figure of FIG. 13, a second example of a waveform WF5 of the pulsed current supplied from the power supply part 8 at the time of printing operation, and so on. In the pulsed current, the duty cycle is set at around 70% by PID control or the like. When the frequency of the pulsed current is set at the first frequency (i.e., 20 kHz), therefore, the pulsed current is in the continuous current mode. This means recovery noise is generated in the pulsed current, with virtually no time section during which the current value is 0 A.

Accordingly, in the pulsed current which is supplied from the power supply part 8 at the time of printing operation and the like, when the length of time section during which the current value is 0 A is shorter than 3 μsec, for example, as shown on the left side of the lower figure of FIG. 13, the frequency of the pulsed current is set at the second frequency (i.e., the frequency of approximately 10 kHz or 125 μsec-cycle (see an arrow G)). Then the pulsed current is in the discontinuous current mode as shown on the right side of the lower figure of FIG. 13 (see a waveform WF6). In this manner, the length of time section during which the current value is 0 A is increased to approximately 3-7 μsec (see an arrow H), in order to prevent recovery noise in the pulsed current.

Figure 14:
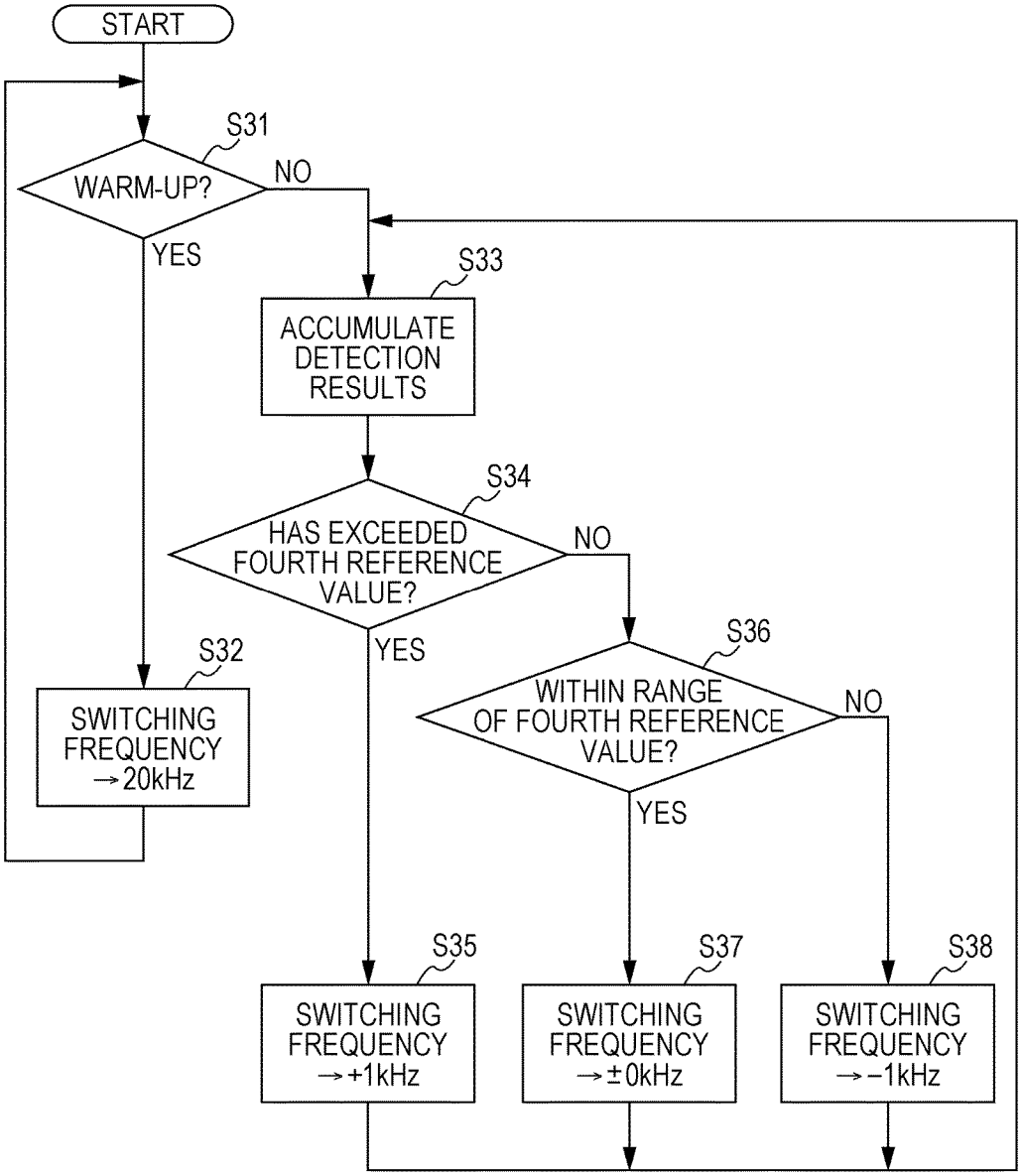
FIG. 14 is a flow diagram illustrating a process performed by the control part in input current control according to the fourth embodiment.

Next, the following description particularly refers to FIG. 14. As shown in FIG. 14, during the warm-up operation (step S31), the control part 7 outputs the second control signal described earlier to the driving circuit 832 (step S32), so as to cause the heater 52 to be on continuously. The second control signal specifies the duty cycle of 100%, and the switching frequency of approximately 20 kHz.

Immediately after the warm-up, the switching frequency is set at approximately 20 kHz. In an operation mode other than the warm-up mode, the control part 7 obtains a detection result from the current detection part 91 at regular intervals, and accumulates the detection results corresponding to, for example, approximately one (1) cycle (step S33). Then the control part 7, by referring to the accumulated detection results, determines whether or not there exists a time section exceeding a predetermined fourth reference value, during which the current value is 0 A, in a current flowing in the heater 52 (step S34). The fourth reference value is determined appropriately in accordance with specifications and characteristics of the freewheeling element D1 and the switching element 831. In the present embodiment, as an example, it is determined whether or not there is a time section exceeding 7 μsec during which the current value is 0 A. When the control part 7 determines there is a time section exceeding the fourth reference value, during which the current value is 0 A, in a current flowing in the heater 52 (Yes in step S34), the control part 7 increases the switching frequency from the present value by a predetermined third frequency (e.g., by 1 kHz) (step S35).

When the control part 7 determines there is not a time section exceeding the fourth reference value, during which the current value is 0 A, in a current flowing in the heater 52 (No in step S34), the control part 7 determines whether or not there exists a time section falling within the range of the fourth reference value, during which the current value is 0 A (step S36). In the present embodiment, as an example, it is determined in step S36 whether or not there is a time section equal to or more than 3 μsec but less than 7 μsec during which the current value is 0 A. When the control part 7 determines there is such time section (Yes in step S36), the control part 7 maintains the switching frequency (step S37). When the control part 7 determines there is no such time section (No in step S36), the control part 7 decreases the switching frequency from the present value by a predetermined fourth frequency (e.g., by 1 kHz) (step S38).

When any one of the above steps S35, S37, and S38 is finished, the control part 7 returns to the process of step S33. The process from step S33 to step S38 is repeated until the main power supply is turned off.

Chapter 15: Effect of the Control of Input Current to the Heater According to the Fourth Embodiment By the input current control of the present embodiment, the sound noise level at a time other than warm-up operation is reduced. In addition, problems such as recovery noise are avoided.

Chapter 16: Supplementary Note 1

In the third embodiment, considering the capacity or follow-up performance of the circuit components such as the power supply part 8, it is desirable that the upper and lower limits of the switching frequency that the control part 7 is allowed to set in the process illustrated in FIG. 14 be, for example, approximately 22 kHz and 6 kHz, respectively.

Chapter 17: Supplementary Note 2

In the second embodiment, the switching frequency is set based on the duty cycle determined by PID control or the like. The control part 7, therefore, does not recognize whether or not a temperature rise of the switching element 831 has actually been prevented with the switching frequency having been set. To solve this problem, a second temperature detection part 93 having a thermistor and the like is mounted on the image forming apparatus 1, as shown in FIG. 2. The second temperature detection part 93 detects the temperature of the switching element 831, and outputs a detection result to the control part 7.

The control part 7 receives, after step S14 or S15 of FIG. 10, the detection result from the second temperature detection part 93. The control part 7 determines that switching loss or the like has been generated, when the received detection result has exceeded a specified second reference value. The second reference value is determined appropriately in accordance with specifications and characteristics of the freewheeling element D1 and the switching element 831. In this case, the control part 7 decreases the switching frequency of the switching element 831 further, so that a pulsed current in the discontinuous current mode can be supplied.

The process described in the present chapter may be added to the first or second embodiment.

Chapter 18: Supplementary Note 3

In the first embodiment, when the image forming apparatus 1 is in printing operation, the switching frequency is set at 10 kHz, taking sound reduction into consideration (see steps S01 and S02 of FIG. 8). However, the switching frequency is not limited to the above. When a user resets the apparatus to disable control of changing the switching frequency, by operating the operation/input part 6 which is an example of the setting part, the control part 7 can set the switching frequency at 20 kHz even in the printing operation.

Alternatively, instead of the operation/input part 6, a hardware switch can be provided in the image forming apparatus 1 as another example of the setting part. In this case, control of changing the switching frequency is enabled and disabled, depending on switching operation with the hardware switch.

The process described in the present chapter can be implemented in the second or third embodiment.

The image forming apparatus according to the embodiments of the present invention is capable of preventing recovery noise in a freewheeling element, and a temperature rise in a switching element. The apparatus is thus suitable for a copying machine, a fax machine, and a printing machine, or a multifunction machine having functions of these machines.

Although the present invention has been described and illustrated in detail, it is clearly understood that the same is by way of illustrated and example only and is not to be taken by way of limitation, the scope of the present invention being interpreted by terms of the appended claims.

What is claimed is:

1. An image forming apparatus comprising:

a fixing part including a heater, and a first temperature detection part configured to detect the temperature of the heater;

a chopper circuit including a reactor, a freewheeling element, and a switching element, the chopper circuit being configured to output an on-and-off current to the heater, wherein the chopper circuit obtains the on-and-off current by switching an on part of a direct current input thereto on and off according to a specified duty cycle by using the switching element; and a control part configured to control the specified duty cycle of the on-and-off current output by the chopper circuit based on a detection result obtained by the first temperature detection part, as well as to control a switching frequency of the switching element based on an operation mode of the image forming apparatus.

2. The image forming apparatus according to claim 1, wherein:

operation modes of the image forming apparatus include a first operation mode in which power consumption of the heater is relatively low, and a second operation mode in which the power consumption is relatively high, and the control part sets the switching frequency to a first frequency, when the control part determines that the operation mode of the image forming apparatus is the first operation mode, and the control part sets the switching frequency to a second frequency which is lower than the first frequency, when the control part determines that the operation mode of the image forming apparatus is the second operation mode.

3. The image forming apparatus according to claim 2, wherein the first frequency is a frequency which is outside an audible range, and the second frequency is a frequency at which a current flowing in the heater is in a discontinuous current mode.

4. The image forming apparatus according to claim 2, wherein the first operation mode includes a mode in which the image forming apparatus is in a standby state, and the second operation mode includes a mode in which the image forming apparatus is in printing operation.

5. The image forming apparatus according to claim 2, further comprising a second temperature detection part configured to detect the temperature of the switching element, wherein the control part decreases the switching frequency further, when a detection result obtained by the second temperature detection part is higher than a specified second reference value, after setting the switching frequency to the first frequency or the second frequency based on the specified duty cycle.

6. The image forming apparatus according to claim 1, wherein the chopper circuit is a step-down chopper circuit.

7. The image forming apparatus according to claim 1, further comprising a setting part capable of setting information indicating that the image forming apparatus does not control the switching frequency, wherein the control part does not implement control of the switching frequency when such information has been set through the setting part.

8. The image forming apparatus according to claim 1, wherein an operation mode is provided in which a direct current in a duty cycle of 100% is supplied to the heater.

* * * * *